US005888375A

United States Patent [19]

Iwata

[11] Patent Number: 5,888,375

[45] Date of Patent: Mar. 30, 1999

[54] METHOD OF TREATING OIL SLUDGE

[76] Inventor: Yoshihiro Iwata, 809-2, Higashiirushuzei-cho Sagaru Nijyo Senbondori, Kamigyo-ku, Kyoto, Japan

[21] Appl. No.: 595,293

[22] Filed: Feb. 1, 1996

[30] Foreign Application Priority Data

Aug. 28, 1995 [JP] Japan ..... 7-240498

[51] Int. Cl.[6] ..... C10G 17/00

[52] U.S. Cl. ..... 208/13; 208/179; 110/346

[58] Field of Search ..... 208/213, 179; 110/346

[56] References Cited

U.S. PATENT DOCUMENTS

| | | | |
|---|---|---|---|
| 4,392,941 | 7/1983 | Roth | 208/13 |
| 4,624,733 | 11/1986 | Chimenti | 204/188 |
| 4,624,764 | 11/1986 | Mintz | 204/188 |
| 4,634,510 | 1/1987 | Mintz | 208/307 |
| 4,686,048 | 8/1987 | Atherton et al. | 208/13 |
| 4,839,022 | 6/1989 | Skinner | 208/468 |
| 4,990,237 | 2/1991 | Heuer et al. | 208/13 |
| 5,269,906 | 12/1993 | Reynolds | 208/13 |

*Primary Examiner*—Helane Myers
*Attorney, Agent, or Firm*—Flynn, Thiel, Boutell & Tanis, P.C.

[57] ABSTRACT

A method of treating oil sludge and an apparatus for carrying out same, whereby oil of good quality and inorganic harmless slag can be easily obtained. The method includes agitating oil sludge in an electrolytic tank so as to liquefy same, extracting waste fluid from the liquefied oil sludge, separating solid material from the liquefied oil sludge with a centrifugal separator, extracting waste fluid including the solid material, transporting the liquefied oil sludge to a precipitation tank, extracting waste fluid which is separated and precipitated in the precipitation tank, applying low frequency oscillation to the oil sludge in fluid supply tubes between the electrolytic tank, centrifugal separator and precipitation tank so as to increase oxygen content, extracting oil from an upper portion of the precipitation tank, and incinerating the extracted waste fluid. The apparatus includes an agitator disposed inside an electrolytic tank, a first fluid supply tube connecting the electrolytic tank and a centrifugal separator, a second fluid supply tube connecting the centrifugal separator and a precipitation tank, an oil supply tube connecting the precipitation tank and the oil tank, coils disposed on the first and second fluid supply tubes for applying a low frequency/low voltage/low current signal, and extracting tubes respectively connected between the electrolytic tank, the centrifugal separator and the precipitation tank for extracting waste fluid.

21 Claims, 1 Drawing Sheet

FIGURE
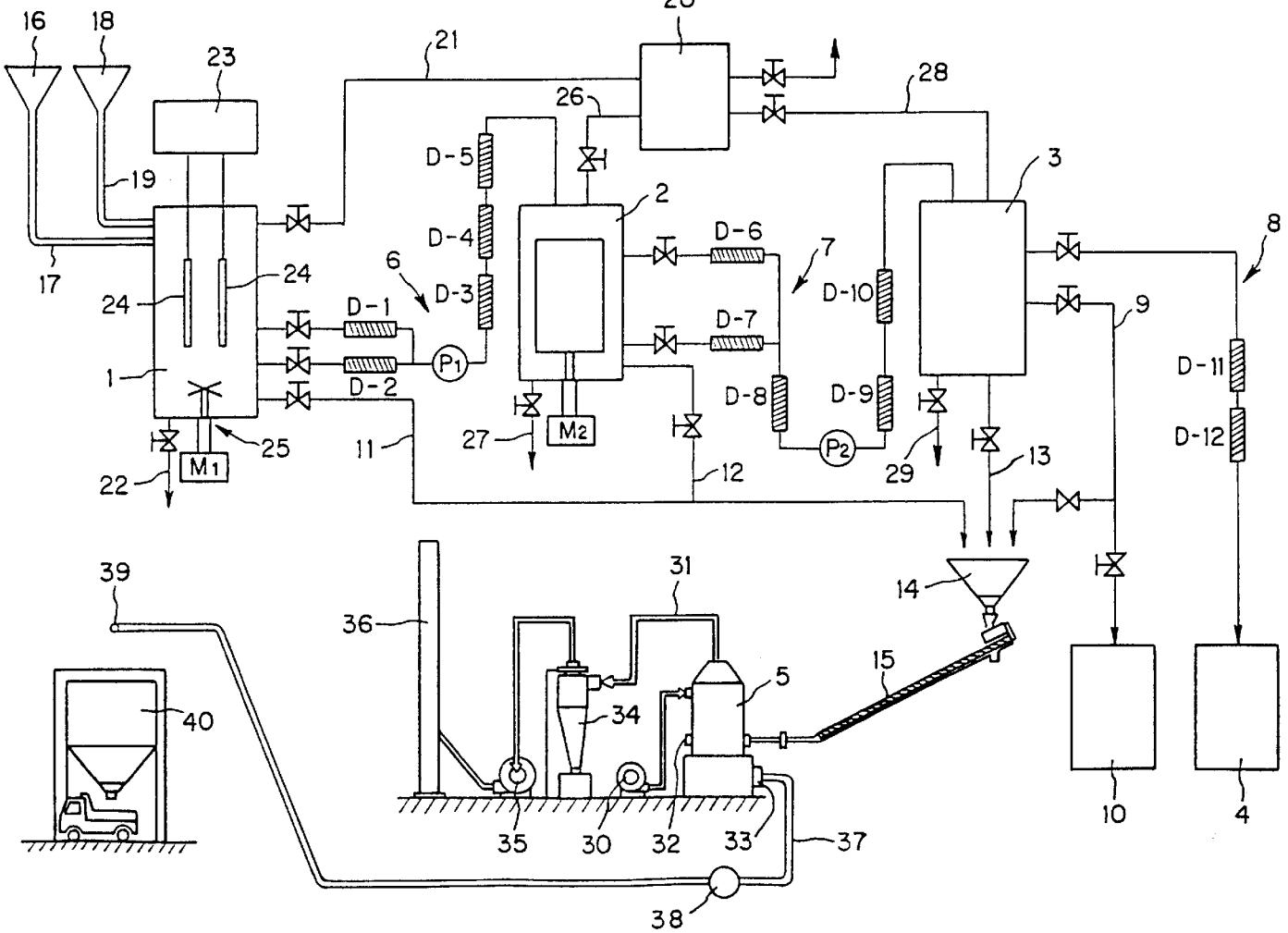

METHOD OF TREATING OIL SLUDGE

BACKGROUND OF THE INVENTION

1. Field of the Invention:

The present invention relates to a method of treating oil sludge and an apparatus for carrying out the same for obtaining oil and inorganic sludge from an oil extracting site or oil sludge accumulated in bottom of oil carriage vessel.

2. Prior Art:

Oil sludge at the oil extracting site or that accumulated in the bottom of oil carriage vessel is in a very strong sticky state where water, sand and other solid materials are mixed with oil. Accordingly, water is added beforehand to or mixed with oil sludge so as to liquefy oil sludge so as to extract oil from sludge, and separate water, sand and other solid materials from sludge, so that the liquefied oil sludge is separated into oil and other materials by a separator.

In the conventional method of treating oil sludge, since sticking force between oil and water, sand and other solid materials is too strong to uniformly mix added water with sludge so that sufficiently liquefied sludge cannot be obtained, and oil is not sufficiently separated by the separator, which prevents this method from being in practical use.

SUMMARY OF THE INVENTION

The present invention has been made in view of the aforementioned problem, and it is an object of the invention to provide a method of treating oil sludge and an apparatus for carrying out the same comprising agitating oil sludge to which water is added in an electrolytic tank, facilitating liquefaction, reducing separating load in a separator so as to easily obtain high quality oil and inorganic harmless slag from oil sludge.

To achieve the above object, a method of treating oil sludge according to a first aspect of the invention comprises agitating oil sludge to which water is added in an electrolytic tank so as to liquefy agitated oil sludge, extracting waste fluid including solid material from said liquefied oil sludge, separating solid material from said liquefied oil sludge by a centrifugal separator, extracting waste fluid including said solid material, leading the liquefied oil sludge to a precipitation tank, extracting waste fluid including solid material which is separated and precipitated in the precipitation tank, applying low frequency oscillation to said oil sludge in fluid supply tubes between said electrolytic tank, centrifugal separator and precipitation tank so as to increase oxygen content, extracting oil from an upper portion of the precipitation tank, and incinerating the extracted waste fluid including solid material by an incinerator.

An apparatus for treating oil sludge according to a second aspect of the invention comprises an electrolytic tank, a centrifugal separator, a precipitation tank, an oil tank, and an incinerator, wherein the apparatus further comprises an agitator disposed inside the electrolytic tank including an oil sludge introduction port and a water introduction port, a first fluid supply tube connecting between the electrolytic tank and the centrifugal separator, a second fluid supply tube connecting between the centrifugal separator and the precipitation tank, an oil supply tube connecting between an upper portion of the precipitation tank and the oil tank, coils disposed midway on the first and second fluid supply tubes for applying a signal having a low frequency, a low voltage and a low current, and extracting tubes respectively connected between the electrolytic tank, the centrifugal separator and the precipitation tank for extracting waste fluid including solid material, wherein the extracting tubes are respectively connected to the incinerator.

BRIEF DESCRIPTION OF THE DRAWING

A single FIGURE shows an arrangement of an apparatus for treating oil sludge.

PREFERRED EMBODIMENT OF THE INVENTION

A method of treating oil sludge and an apparatus for carrying out the same will be described now with reference to the lone drawing figure. In the figure, denoted by 1 is an electrolytic tank, 2 is a centrifugal separator, 3 is a precipitation tank, 4 is an oil tank, and 5 is an incinerator wherein the electrolytic tank 1 and the centrifugal separator 2 are connected to each other by a first fluid supply tube 6, and the centrifugal separator 2 and the precipitation tank 3 are connected to each other by a second fluid supply tube 7, and the precipitation tank 3 and the oil tank 4 are connected to each other by an oil supply tube 8. A water discharge tube 9 attached to the precipitation tank 3 is connected to a water discharge tank 10. Further, extracting tubes 11, 12, 13 are respectively attached to the electrolytic tank 1, the centrifugal separator 2 and the precipitation tank 3, and they gather at a hopper 14. A screw conveyor 15 is interposed between the hopper 14 and the incinerator 5. A sludge supply tube 17 extending from an oil sludge introduction port 16, a water supply tube 19 extending from a water introduction port 18, a vapor discharge tube 21 attached to a refrigeration device 20 and a drain tube 22 are respectively connected to the electrolytic tank 1. The first fluid supply tube 6 and the extracting tube 11 are also connected to the electrolytic tank 1. Denoted by 23 is an electrode control unit to which corrosion resistant titanous electrodes 24 and 24 are attached. An agitator 25 comprises an agitating blade and a motor M1 wherein the agitating blade is disposed inside the electrolytic tank 1 and the motor M1 is disposed outside the electrolytic tank 1.

Coils D-1 through D-5 for receiving a signal having low frequency, low voltage and low current and a pump P1 are respectively provided midway on the first fluid supply tube 6 between the electrolytic tank 1 and the centrifugal separator 2. A vapor discharge tube 26 is attached to the refrigerator 20. The first fluid supply tube 6, the second fluid supply tube 7, the extracting tube 12, and a drain tube 27 are respectively connected to the centrifugal separator 2. The centrifugal separator 2 is driven by a motor M2.

The coils D-6 through D-10 for receiving a signal having low frequency, low voltage and low current and a pump P2 are respectively provided midway on the second fluid supply tube 7 between the centrifugal separator 2 and the precipitation tank 3.

The second fluid supply tube 7, an oil return tube 28 attached to the refrigerator 20, the oil supply tube 8, the extracting tube 13 and a drain tube 29 are respectively connected to the precipitation tank 3.

The coils D-11 and D-12 for receiving low frequency/low voltage/low current signal are respectively provided midway on the oil supply tube 8 between the precipitation tank 3 and oil tank 4.

A fan 30 for supplying air for incineration and ventilation, a flue tube 31, a fuel supply port 32, the screw conveyor 15 and a slag discharge port 33 are respectively connected to the incinerator 5. A cyclone dust collector 34 and a blower 35 are disposed midway on the flue tube 31. A distal end of the flue tube 31 is connected to a chimney 36. A blower 38 is disposed midway on a slag carrier tube 37 attached to the slag discharge port 33 of the incinerator 5, and a distal end opening 39 of the slag carrier tube 37 is positioned over a slag hopper 40.

With such an arrangement, the oil sludge is supplied from the oil sludge introduction port 16 to the electrolytic tank 1, and water in the amount of one third of the sludge is supplied from the water introduction port 18 to the electrolytic tank 1. This oil sludge and water are strongly agitated by the agitator 25 in the electrolytic tank 1 so that water, sand and other solid material which are stuck to the oil are separated from the oil. Further, molecules of water generated by the electrolysis of water by both electrodes 24 and 24 are ionized and they are likely to stick to both electrodes 24 and 24. As a result, the separation of water, sand and other solid materials from oil is further facilitated while water, sand and other solid materials move. The oil sludge is reduced in its viscosity, and is changed to liquefied oil sludge, and sand and other solid materials come from the oil are extracted to the extracting tube 11 thereby separating solid materials from oil. Vapor of oil evaporated in the electrolytic tank 1 is led from the vapor discharge tube 21 to the refrigeratory 20. When a signal having a current ranging from 10 to 50A and a voltage of about 50 V is applied from the electrode control unit 23 to the electrodes 24 and 24 depending on the condition of the oil sludge, a good result is obtained.

When waste fluid including sand and solid material is extracted from the extracting tube 11, the oil sludge, which is reduced in the amount of solid material, is liquefied, and oscillated by the signal having a low frequency, a low voltage and a low current applied to the coils D-1 through D-5 during the passage in the first fluid supply tube 6 so that liberated oxygen permeates the oil so as to increase oxygen content. The pump P1 facilitates the flow of oil sludge in the first fluid supply tube 6. The tube including the coil D-1 and the tube including the coil D-2 are arranged in parallel with each other for uniformly discharging the liquefied oil sludge from the electrolytic tank 1. An excellent test result is obtained when the signal having a current of 2 mA, a voltage of 1.5 V and a frequency ranging from 30 to 200 Hz is applied to the coils D-1 through D-5 wherein the frequency is increased in descending order from the coils D-1 toward D-5.

The thus liquefied oil sludge having increased oxygen content enters the centrifugal separator 2 through the first fluid supply tube 6 wherein water, sand and other solid materials stuck to the oil are centrifugally separated from the oil so that the liquefaction of the oil sludge is further facilitated. The sand and other solid materials which come off and are separated from the oil, thus are moved away from the oil and individually extracted toward the extracting tube 12. The vapor of oil evaporated in the centrifugal separator 2 is led from the vapor discharge tube 26 to the refrigeratory 20.

The waste fluid including the sand and other solid materials is extracted through the extracting tube 12 so that the solid material content of the liquefied oil sludge is further reduced, and this liquefied oil sludge is discharged from the centrifugal separator 2 toward the second fluid supply tube 7. The discharged oil sludge is oscillated by the signal having a low frequency, a low voltage and a low current which is applied to the coils D-6 through D-10 during the passage in the second fluid supply tube 7 so as to permeate the liberated oxygen into the oil so that the oxygen content is further increased. The pump P2 facilitates the flow of the oil sludge in the second fluid supply tube 7 like the pump P1 in the first tube 6. An excellent test result is obtained when a signal having the current of 2 mA, a voltage of 1.5 V and a frequency ranging from 220 to 360 Hz is applied to the coils D-6 through D-10 wherein the frequency is increased in the descending order from the coils D-6 toward D-10.

The thus liquefied oil sludge having increased oxygen content enters the precipitation tank 3 from the second fluid supply tube 7, so that water, sand and other solid materials still mixed with the oil are precipitated in the precipitation tank 3 and separated from the oil. At this time, the oil liquefied from vapor of the oil in the refrigeratory 20 is supplied from the oil return tube 28 to the precipitation tank 3.

The oil having increased oxygen content floats on the upper portion of the precipitation tank 3, and is then led to the oil supply tube 8. The oil is oscillated by the signal having a low frequency, a low voltage and a low current applied to the coils D-11 and D-12 during the passage in the oil supply tube 8 so as to allow the liberated oxygen to permeate the oil, which further increases oxygen content. An excellent test result is obtained when the signal having the current of 2 mA, the voltage of 1.5 V and the frequency ranging from 30 to 60 Hz is applied to the coils D-11 and D-12. Water collected at the middle portion of the precipitation tank 3 is discharged to the water discharge tank 10 through the water discharge tube 9.

The waste fluid including the sand and other solid materials which is collected at the lower portion of the precipitation tank 3 is discharged from the precipitation tank 3 to the hopper 14. The waste fluid including the sand and other solid materials is also discharged from the extracting tubes 11 and 12 to the hopper 14. The organic sand and other solid materials which are discharged to the hopper 14 are transferred to the incinerator 5 by the screw conveyor 15, and they are incinerated in the incinerator 5 by combustion heat from the waste oil, etc., and are changed into minute inorganic slag. This slag is led from the slag discharge port 33 to the distal end opening 39 through the slag carrier tube 37, and is collected in the slag hopper 40 so as to be reutilized.

Combustion gas generated by the incineration of the waste oil or gas in the incinerator 5 is purified in the cyclone dust collector 34 midway on the flue tube 31, and thus purified clean combustion gas is led from the blower 35 to the chimney 36, and is finally discharged from the chimney 36.

As mentioned in detail above, water is added to the oil sludge having high viscosity and they are agitated and subjected to the electrolysis so that the oil sludge is liquefied and the waste fluid including the solid material is extracted. Successively the solid material is separated from the liquefied oil sludge in the centrifugal separator so as to extract the waste fluid including such a solid material, then the liquefied oil sludge is led to the precipitation tank. Then, the waste fluid including the separated and precipitated solid material in the precipitation tank is extracted and the signal having a low frequency, a low voltage and a low current is applied to the oil sludge in the fluid supply tubes between the electrolytic tank, the centrifugal separator and the precipitation tank so as to increase the oxygen content, then the oil is extracted from the upper portion of the precipitation tank. Thereafter, the thus extracted waste fluid including solid material is incinerated in the incinerator so as to obtain the inorganic slag. Accordingly, the oil sludge can be very easily liquefied, and the other materials can be surely separated from the oil so as to obtain oil of good quality, and the harmless slag can be easily extracted.

According to the present invention, oil sludge can be easily liquefied, then the other materials can be surely separated from the oil, and the waste material is incinerated so as to simply and surely obtain oil and harmless slag.

Since the low frequency oscillation can be applied to the liquefied oil sludge so as to increase oxygen content, it is possible to provide the method of treating oil sludge and the apparatus for carrying out the same capable of obtaining oil of good quality adapted for combustion.

What is claimed is:

1. In a method of treating oil sludge to obtain oil and inorganic slag from said oil sludge, said method comprising the steps of:

adding water and oil sludge to an electrolytic tank;

agitating the oil sludge and water in the electrolytic tank so as to liquefy the oil sludge;

extracting a first waste fluid including solid material from said liquefied oil sludge in the electrolytic tank;

transporting the liquefied oil sludge from the electrolytic tank to a centrifugal separator;

applying a first signal having a first frequency to the liquefied oil sludge as it is transported to the centrifugal separator;

separating solid material from said liquefied oil sludge by operation of the centrifugal separator;

extracting a second waste fluid including said solid material which is separated in the centrifugal separator;

transporting said liquefied oil sludge to a precipitation tank;

applying a second signal having a second frequency to the liquefied oil sludge as it is transported to the precipitation tank, said second frequency being different from said first frequency;

precipitating a waste fluid including solid materials from the liquefied oil sludge in the precipitation tank;

extracting a third waste fluid including solid material which is separated and precipitated in the precipitation tank;

extracting oil from an upper portion of said precipitation tank; and incinerating said extracted waste fluids including solid material, which is separated and precipitated in said electrolytic tank, said centrifugal separator and said precipitation tank, in an incinerator.

2. The method according to claim 1, wherein the steps of applying the first and second signals include applying an electrical signal to the liquefied oil sludge during respective transportation to the centrifugal separator and precipitation tank thereby oscillating the oil sludge during transportation.

3. The method according to claim 2, wherein the first electrical signal has a frequency in the range of about 30 Hz to about 200 Hz and the second electrical signal has a frequency in a range of about 220 Hz to about 360 Hz, each of the first and second electrical signals having a current of about 2 mA and a voltage of about 1.5 V.

4. The method according to claim 2, wherein the step of transporting the liquefied oil sludge from the electrolytic tank to the centrifugal separator includes transporting the liquefied oil sludge sequentially past coils which receive the first electrical signal, and reducing the frequency of the first electrical signal sequentially applied to individual coils along the transportation direction of the liquefied oil sludge toward the centrifugal separator.

5. The method according to claim 4, wherein the step of transporting the liquefied oil sludge from the centrifugal separator to the precipitation tank includes transporting the liquefied oil sludge past coils which receive the second electrical signal, and reducing the frequency of the second electrical signal sequentially applied to individual coils along the transportation direction of the liquefied oil sludge toward the precipitation tank.

6. The method according to claim 5, wherein after the step of extracting oil from the upper portion of the precipitation tank, performing the following steps:

transporting the extracted oil to an oil tank; and oscillating the extracted oil by applying a third electrical signal to the extracted oil during transport to the oil tank.

7. The method according to claim 6, further comprising the steps of:

venting oil vapor from the electrolytic tank and centrifugal separator to a refrigeration device, condensing the oil vapor to liquefied oil in the refrigeration device; and transporting the oil from the refrigeration unit to the precipitation tank.

8. The method according to claim 6, further comprising the steps of:

providing electrodes in the electrolytic tank;

controlling the electrodes with an electrode control unit; and ionizing water in the electrolytic tank to facilitate separation of waste material from the oil sludge.

9. The method according to claim 6, further comprising the steps of extracting water from a middle portion of the precipitation tank, and transporting the extracted water to a water discharge tank.

10. The method according to claim 6, wherein the incineration step includes the steps of:

creating and discharging slag; and purifying exhaust gases created during incineration before discharging the exhaust gases into the air.

11. The method according to claim 1, wherein said second frequency is greater than said first frequency.

12. The method according to claim 1, wherein said first frequency is in a range of about 30 Hz to about 200 Hz and said second frequency is in a range of about 220 Hz to about 360 Hz.

13. A method of treating oil sludge, comprising the steps of:

combining water and oil sludge in a first tank;

agitating the water and oil sludge in the first tank to further liquefy the oil sludge;

extracting a first waste material from the liquefied oil sludge in the first tank;

transporting the liquefied oil sludge from the first tank to a second tank;

applying an electrical signal to oscillate the liquefied oil sludge during transport thereof to the second tank so as to permeate oxygen in the liquefied oil sludge;

extracting a second waste material from the liquefied oil sludge in the second tank;

discharging the second waste material from the second tank;

transporting the liquefied oil sludge from the second tank to a third tank;

applying an electrical signal to oscillate the liquefied oil sludge during transportation thereof to the third tank so as to permeate oxygen in the liquefied oil sludge;

centrifugally separating waste material from the oil sludge in one of the first, second and third tanks;

precipitating waste material from the liquefied oil sludge in a second of the first, second and third tanks; and discharging oil from an upper portion of the third tank.

14. The method according to claim 13, wherein the step of applying an electrical signal to oscillate the liquefied oil sludge during transport to the second tank includes applying a first signal having a frequency in a range of about 30 Hz to about 200 Hz to first coils adjacent a pipe through which the liquefied oil sludge is transported; and wherein the step of applying an electrical signal to oscillate the liquefied oil sludge during transport to the third tank includes applying a second signal having a frequency in a range of about 220 Hz to about 360 Hz to second coils adjacent a pipe through which the liquefied oil sludge is transported.

15. The method according to claim 14, wherein the first and second signals have a current of about 2 mA and a voltage of about 1.5 V.

16. The method according to claim 14, further comprising the steps of decreasing the frequency of the first signal applied to successive first coils in the transportation direction of the liquefied oil sludge, and decreasing the frequency of the second signal applied to successive second coils in the transportationdirection of the liquefied oil sludge.

17. A method for treating oil sludge resulting in oil and slag, comprising the steps of:

separating a first waste material from the oil sludge in a first tank by agitating and electrolyzing the oil sludge to create a first-treated oil sludge;

transporting the first-treated oil sludge to a centrifugal separator;

applying an electrical signal to oscillate the first-treated oil sludge during the transporting thereof to the centrifugal separator so that oxygen permeates the first-treated oil sludge;

separating a second waste material from the first-treated oil sludge in the centrifugal separator to create a second-treated oil sludge;

transporting the second-treated oil sludge to a second tank; applying an electrical signal to oscillate the second-treated oil sludge during the transporting thereof to the second tank so that oxygen permeates the second-treated oil sludge;

precipitating slag from the second-treated oil sludge in the second tank so that oil is separated from the slag;

discharging oil from the second tank; and applying an electrical signal to oscillate the oil during the discharging step so that oxygen permeates the oil.

18. The method for treating oil sludge according to claim 17, wherein the step of applying an electrical signal to oscillate the first-treated oil sludge includes applying electrical signals to respective coils adjacent a pipe for transporting the first treated oil sludge to oscillate the first-treated oil sludge, and sequentially decreasing the frequency of the electrical signals to the coils positioned in the transporting direction of the first-treated oil sludge.

19. The method according to claim 17, wherein the step of applying an electrical signal to oscillate the second-treated oil sludge includes applying electrical signals to respective coils adjacent a pipe for transporting the second-treated oil sludge to oscillate the second-treated oil sludge, and sequentially decreasing the frequency of the electrical signals to the coils positioned in the transporting direction of the second-treated oil sludge.

20. The method according to claim 17, further comprising the steps of:

extracting waste material and slag from the first and second tanks and the centrifugal separator; and incinerating the waste material and slag.

21. The method according to claim 17, wherein the step of applying an electrical signal to oscillate the first-treated oil sludge includes applying an electrical signal having a frequency in a range of about 30 Hz to about 200 Hz, and the step of applying an electrical signal to oscillate the second-treated oil sludge includes applying an electrical signal having a frequency in a range of about 220 Hz to about 360 Hz.

* * * * *